United States Patent [19]

Sassak

[11] Patent Number: 5,029,872

[45] Date of Patent: Jul. 9, 1991

[54] SPACESHIP TOY AND GAME

[76] Inventor: Mark S. Sassak, 1340 Linden, Plymouth, Mich. 48170

[21] Appl. No.: 398,533

[22] Filed: Aug. 25, 1989

[51] Int. Cl.[5] ..... F41J 5/02; A63H 33/40

[52] U.S. Cl. ..... 273/312; 273/85 G; 446/179; 446/225

[58] Field of Search ..... 273/310–312, 273/85 G; 446/179, 178, 225

[56] References Cited

U.S. PATENT DOCUMENTS

| | | | |
|---|---|---|---|
| 2,074,363 | 3/1937 | Burke | 446/173 |
| 2,890,537 | 6/1959 | Benko | 40/412 |
| 2,924,033 | 2/1960 | Lanctot | 40/407 |
| 3,202,425 | 8/1965 | Van Hennik | 273/312 |
| 3,292,304 | 12/1966 | Wolfe | 446/225 |
| 3,465,471 | 9/1969 | Friedman | 446/178 |
| 3,500,579 | 3/1970 | Bryer | 446/179 |
| 4,045,906 | 9/1977 | Goldfarb et al. | 446/173 |
| 4,057,929 | 11/1977 | Ogawa | 446/178 |
| 4,211,412 | 7/1980 | Barlow et al. | 273/424 |
| 4,250,657 | 2/1981 | Barlow et al. | 446/178 |
| 4,265,047 | 5/1981 | Meyer et al. | 446/7 |
| 4,292,755 | 10/1981 | Houn | 446/176 |
| 4,573,938 | 3/1986 | Sassak | 446/179 |

OTHER PUBLICATIONS

Collector's Armoury, Inc., 1986–87 Catalog, p. 39, Alexandria, Va.

*Primary Examiner*—Benjamin Layno

*Attorney, Agent, or Firm*—Harness, Dickey & Pierce

[57] ABSTRACT

A spaceship type toy and game is disclosed employing a tube and a generally spherical toy space capsule received by the tube. A fan assembly beneath the spacecraft provided air pressure which, when sufficiently great, causes the space capsule to translate within the tube, thus stimulating space travel over a limited distance. By providing an adjustable electrical power supply to the fan assembly the position of the capsule within the tube can be controlled by the user. A pair of side thrust fans on the spherical toy capsule provide airflow in a horizontal direction to cause rotation of the space capsule about the vertical axis of the tube. In addition, a simulated laser cannon is provided in the space capsule which emits a light beam. A space city screen containing targets partially surrounds the spaceship toy. In use, the user will control the height and rotation of the space capsule and will fire the laser cannon at the targets in the space city screen. The targets include photo sensors which permit the detection of the light from the laser cannon. When the sensors detect light the user will be notified by audible or visual means. In addition, the spaceship toy and game may keep score by counting the number of times targets have been hit.

15 Claims, 8 Drawing Sheets

SPACESHIP TOY AND GAME

BACKGROUND AND SUMMARY OF THE INVENTION

This invention relates to a toy and game, and particularly, to a fantasy toy and game simulating a spaceship.

Toys and games serve a number of useful purposes such as providing entertainment, developing creativity, as teaching aids, to promote social interaction, etc. Some types of toys and games also promote the development of certain skills such as hand/eye coordination. An example of a toy which promotes the development of hand/eye coordination is found in U.S. Pat. No. 4,573,938, issued to the present inventor, entitled "Spaceship Type Toy". That patent discloses a spherical toy space capsule contained in a vertically disposed tube having a fan at its base. The fan provides air pressure to raise the toy's space capsule and the user can raise and lower the space capsule by means of a control.

To increase interest in the user, it is desirable to provide even more sophisticated toys. It is further desirable to provide more control over the toys, such as the above mentioned spaceship, to provide a greater challenge and to develop higher levels of skill in hand/eye coordination in the user. It is also desirable to provide such a toy which can also be used in a game setting to further increase interest and challenge, by introducing a competitive element to the activity.

In view of the foregoing, it is a principal of this invention to provide a spaceship toy and game which is controllably moveable in a rotating motion about a vertical axis, as well as in an up and down motion. It is a further object of this invention to provide a spaceship toy which can be used in a game setting which includes a laser cannon which can be fired by the user at targets. It is another object of this invention to provide a means for controlling the up and down and angular rotation movement of the toy space capsule, and also for controlling the firing of the laser cannon. It is yet another object of this invention to provide a spaceship toy and game which provides fantasy targets, for the user to fire the cannon at, which respond in some manner when hit. It is another object of this invention to provide a spaceship toy and game which challenges the user by keeping score of successful hits of the targets and increases the difficulty of skill required to successfully hit the targets.

The above principal aspects of this invention are provided by a spaceship toy and game having a spherical toy space capsule, which is closely received by an elongated transparent tube. The tube has an enclosed lower end where it is attached to a base assembly. Within the base assembly is a fan assembly which provides positive air pressure to the lower ends of the tube, thus causing the space capsule to become suspended within the tube. The fan assembly is energized by a variable output power supply, enabling the user to control the position of the capsule within the tube. The space capsule has two additional fan assemblies providing air flow in opposite horizontal directions resulting in side thrust which causes rotation of the space capsule within the tube. These side thrust fan assemblies may be energized by the user, one at a time, to provide rotation in any desired direction. An energy emitting simulated laser cannon is also provided on the space capsule which can be fired by the user. One or more targets are provided which are responsive to the energy emitted by the laser cannon and which provide a response indicating to the user when the energy emitted by the laser cannon has struck the target.

Additional features of this invention include a wireless transmission means for controlling the motion of the space capsule as well as the firing of the cannon, thereby increasing the freedom of motion of the space capsule.

Additional benefits and advantages of the present invention will become apparent to those skilled in the art to which this invention relates from the subsequent description of the preferred embodiments of this invention and the appended claims, taken in conjunction with the accompanying drawings.

DETAILED DESCRIPTION OF THE INVENTION

Figure 1:
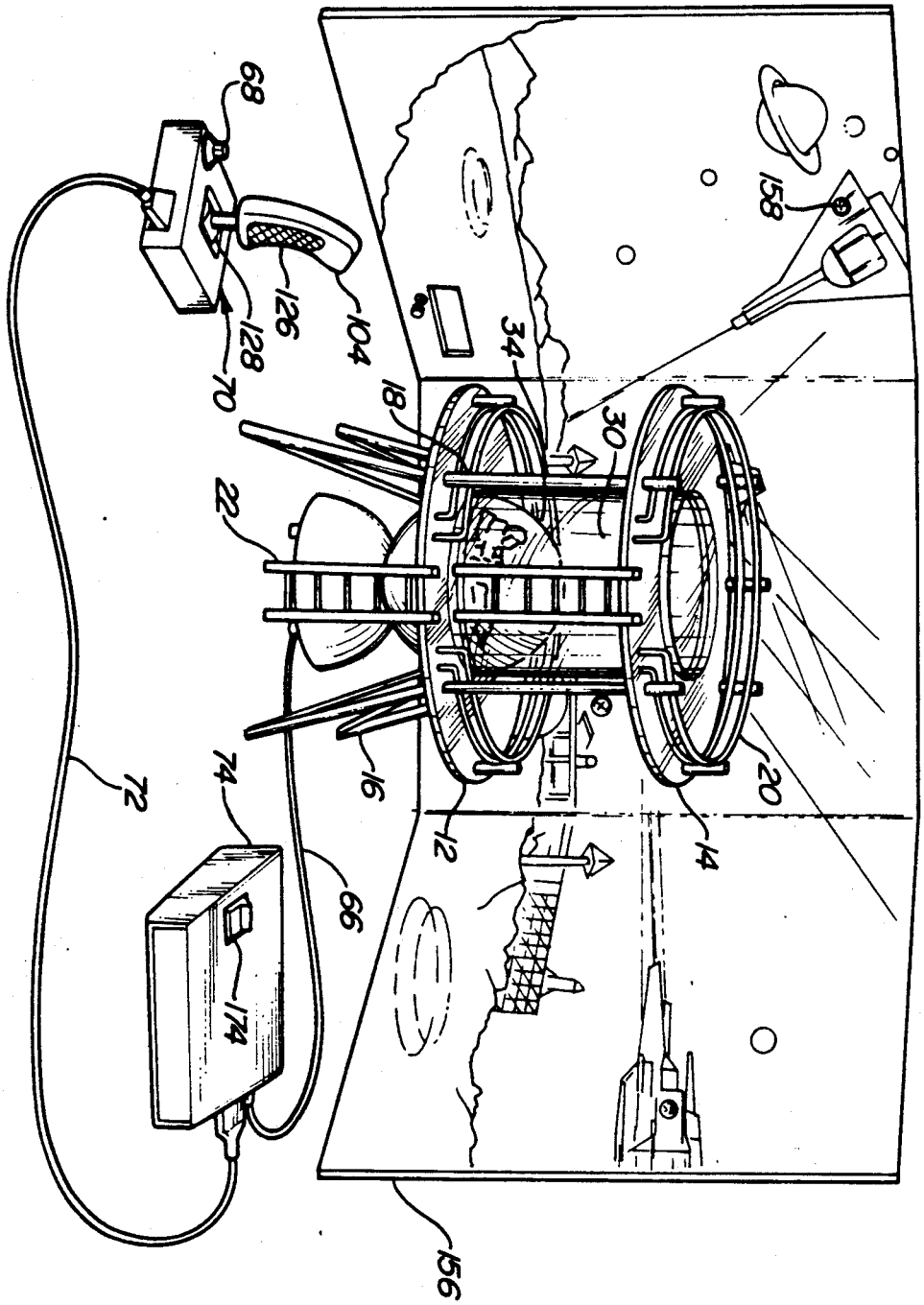
FIG. 1 is a pictorial view of a spaceship toy and game according to this invention.

A spaceship toy and game according to this invention is shown particularly by FIG. 1 and is generally designated by reference character 10. Toy and game 10 comprises a central assembly surrounded by a first level platform 12 and a second level platform 14. The first level platform 12 includes a plurality of legs 16. The first level platform 12 and the second level platform 14 are connected by a series of vertical support posts 18. Each platform 12 and 14 have a set of circumferentially oriented rails 20. Ladders 22 are positioned near the first and second platforms 12 and 14 so that toy figures (not shown) may be caused to climb the ladders and may be positioned on each platform during use of the toy. The central assembly is shown in cross section in FIG. 2 and includes base assembly 24 having upper base portion 26 and lower base portion 28 An elongated cylindrical transparent tube 30 is attached to upper base portion 26 by flange 32. A substantially spherical shaped spacecraft 34, shown in FIG. 1, is inserted within tube 30 and normally resides in the lower position as illustrated in FIG. 1.

Figure 2:
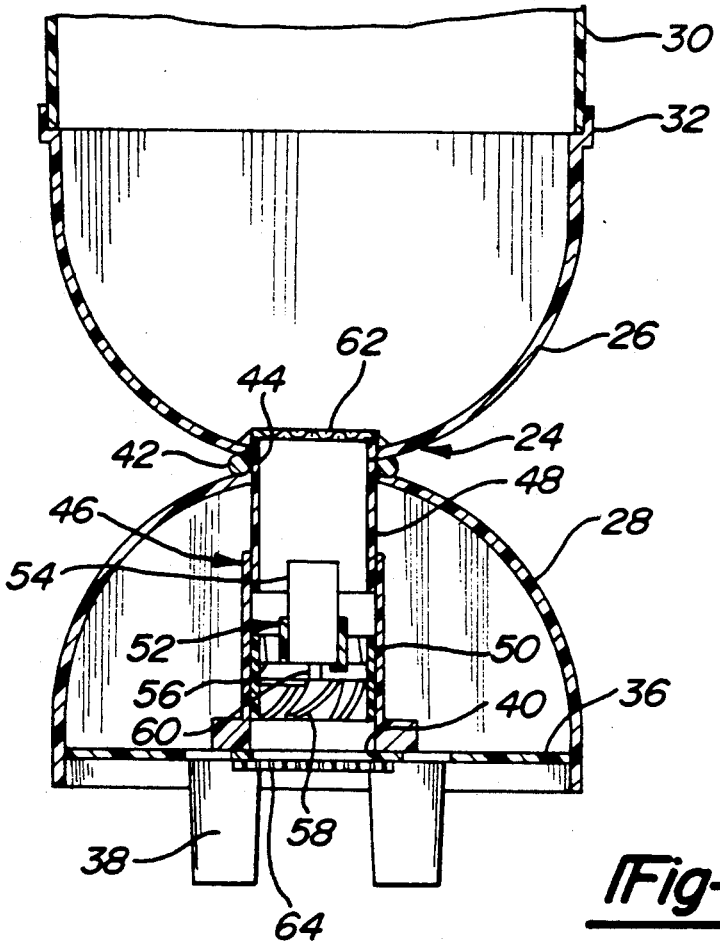
FIG. 2 is a cutaway side view of the base and lift fan assembly.

The internal components of base assembly 24 are shown particularly by FIG. 2. Within lower base portion 28 is bottom panel 36 which supports foot pegs 38 and defines central aperture 40. Upper and lower base portions 26 and 28 are formed from inverted half spheres which are joined by collar 42 and define a central aperture 44. Disposed between apertures 40 and 44 is fan duct assembly. Fan duct assembly 46 is made of two telescopingly interfitting duct portions, upper duct portion 48 and lower duct portion 40. Within duct portion 50 is disposed fan assembly 52 comprising electric motor 54 which is positioned by supports 56 and which is connected to axial flow fan 58 by shaft 60. Supports 56 are preferably designed such as not to impose a significant airflow restriction within the annual cavity around electric motor 54. Fan assembly 52, as shown, is of the type normally used within currently available portable electric hair dryers. Upper duct portion 48 telescopes within lower duct portion 50 such that fan duct assembly 46 extends between apertures 50 and 44. At each end of fan duct assembly 46 are screens which prevent ingestion of large particles and prevent access to the moving fan. Outlet screen 62 is located at the upper end of fan duct assembly 46, whereas inlet screen 64 is disposed at the bottom portion of the fan duct assembly. Power supply leads 66 provide electrical current to motor 54. Motor 54 is preferably of the universal variety which may be speed modulated by providing a variable voltage DC power supply.

In operation, rotation of axial flow fan 58 causes air to flow into inlet screen 64 and out from outlet screen 62, thus increasing the air pressure in upper base portion 26. When sufficient air pressure is provided, toy space capsule 34 is caused to translate vertically upward. This motion occurs when the difference in air pressure between the upper and lower portions of the capsule, which when acting on the cross-sectional area of the capsule, produces a force which exceeds the weight of the capsule. Capsule 34 may be caused to rise within tube 30 until the capsule 34 reaches the uppermost edge of tube 30. Unless the fan assembly 52 has an extremely high airflow capability, the top of tube 30 is the highest position which the capsule 34 can rise to, since the output of the blower assembly is no longer confined above the end of the tube 30. A small annular gap is preferably provided between capsule 34 and the inner diameter of tube 30. This annular gap provides a degree of controlled air leakage which enables control over the vertical position of the capsule 34.

The position of the capsule 34 within the tube 30 may be controlled by knob 68 which is attached to joy stick module 70. A multiconductor lead 72 connects the joy stick controller 70 with a transmitter module 74. The transmitter module 74 contains a conventional variable power supply circuit (not shown), which is employed to energize electric motor 54 under control of the knob 68. Numerous other types of variable power supply systems could be employed, such as the one disclosed in U.S. Pat. No. 4,573,938, which is incorporated herein by reference. In operation, the user turns rotatable knob 68 clockwise which increases the speed of motor 54, thereby causing capsule 34 to rise. Counterclockwise motion of knob 68 will reduce the speed of fan motor 54, thereby lowering the position of capsule 34 in tube 30.

Figure 3:
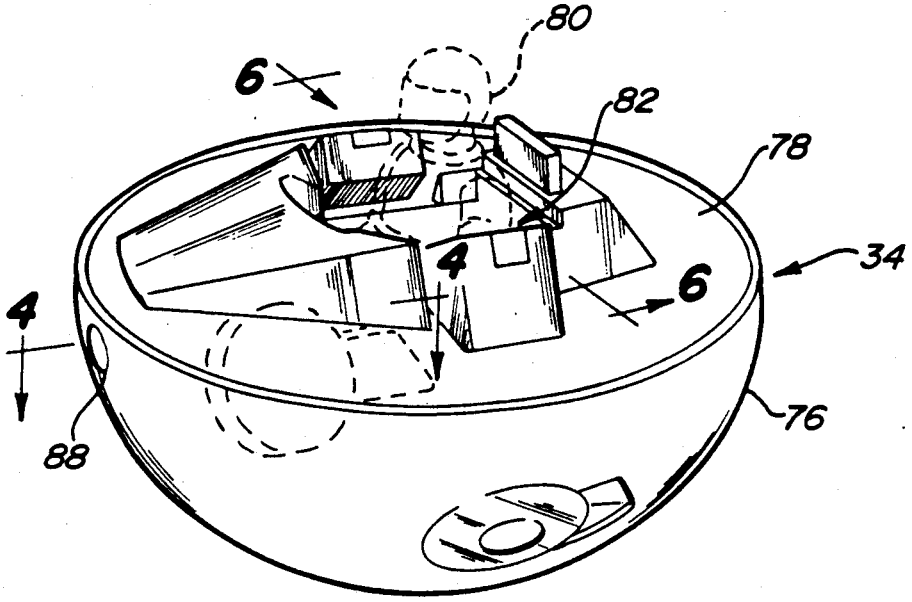
FIG. 3 is a perspective view of the lower portion of the space capsule according to this invention.
Figure 4:
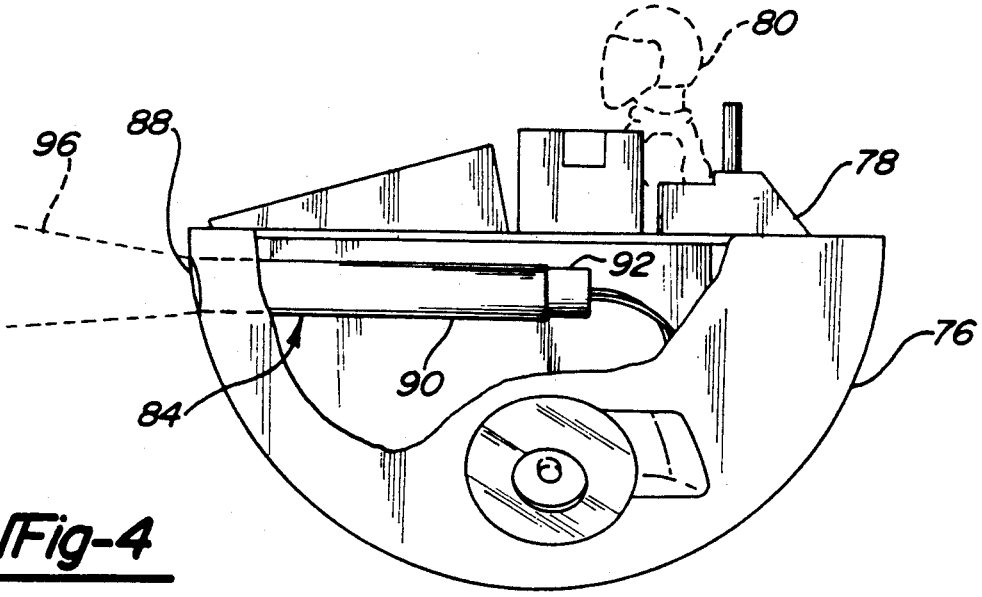
FIG. 4 is a side view of the lower portion of the space capsule, partially in cross-section, taken along line 4—4 in FIG. 3.
Figure 4A:
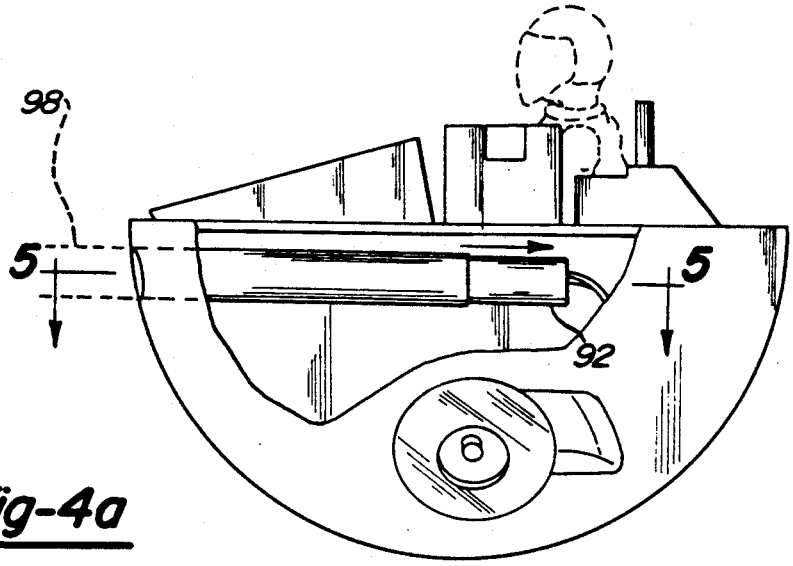
FIG. 4*a* is a view of the lower portion of the space capsule, similar to the view in FIG. 4, with the laser cannon light focus mechanism in an extended position.
Figure 5:
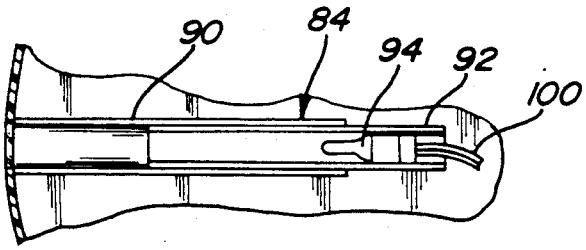
FIG. 5 is a sectional view of the telescoping light cannon mechanism taken along line 5—5 in FIG. 4*a;*
Figure 8:
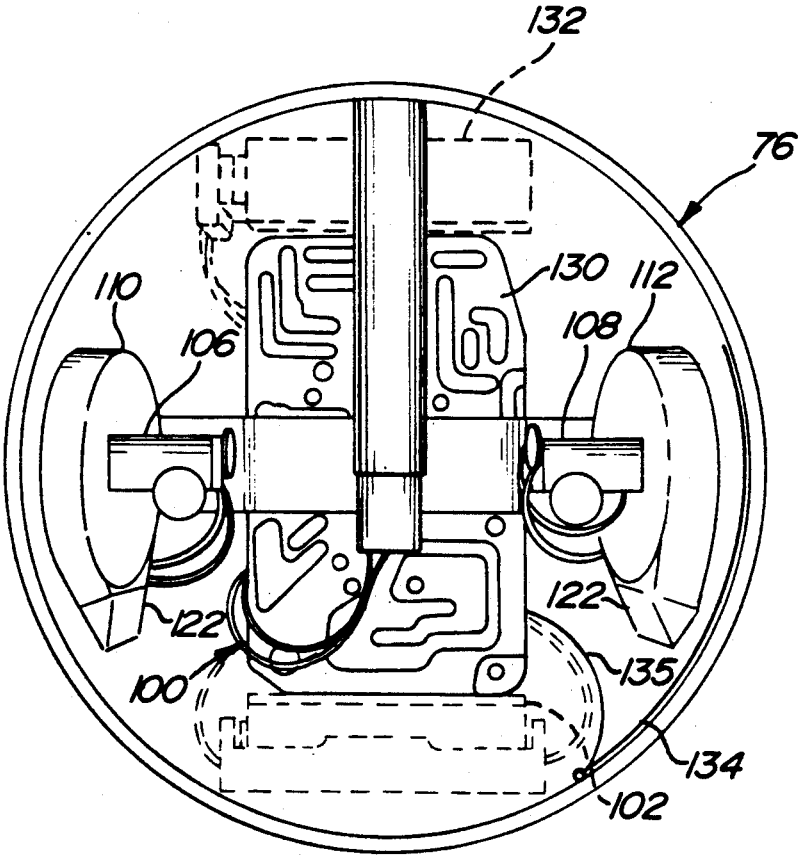
FIG. 8 is a top view of the lower portion of the space capsule assembly with the space capsule cockpit removed.

The capsule 34 is shown in FIG. 3 with the upper transparent portion removed. A lower half spherical portion 76 is shown with a generally planar bulkhead panel portion 78 forming an enclosure over the top of lower capsule portion 76. Bulkhead panel 78 is decorated to resemble the interior of a spacecraft, including a number of gage readouts and simulated instrumentation. Supported by bulkhead panel 78 is a toy astronaut FIG. 80 positioned within seat 82. FIG. 4 illustrates a cross section of the lower portion of the capsule 76 taken along line 4—4 in FIG. 3. A laser cannon assembly 84 is positioned within lower capsule portion 76 adjacent to a magnifying lens 88 positioned in an opening in the lower capsule portion 76. The laser cannon assembly 84 includes a fixed outer sleeve 90 and a telescoping inner sleeve 92. In FIG. 4 the inner sleeve 92 is in a retracted position. In FIG. 4A inner sleeve 92 is shown extended. FIG. 5 illustrates further details of the laser cannon 84 in a cross-section taken along line 5—5 in FIG. 4A. Within inner sleeve 92 is an infrared emitting diode 94. It should be noted that other energy emitting devices such as a light emitting diode, high energy light bulb, or ultrasonic transducer could be substituted for infrared diode 94. The motion of inner sleeve 92 permits adjustment of the beam of energy from laser cannon 84. In particular, when inner sleeve 92 is in the retracted position as shown in FIG. 4, the infrared energy emitted by laser cannon 84 diverges as shown by dotted lines 96. However, when the inner sleeve 92 is in the extended position as shown in FIG. 4A, the infrared beam is more collimated, as shown by dotted lines 98. Power to the infrared emitting diode 94 is provided through conductors 100 which lead to battery 102 contained in the capsule lower portion 76 as shown in FIG. 8. The laser cannon 84 may be fired by the user by means of a trigger button 104 contained in the joy stick module 70 shown in FIG. 1. The trigger button 104 is coupled through the transmitter module 74 by means of radio frequency energy as will be discussed in more detail below.

Figure 6:
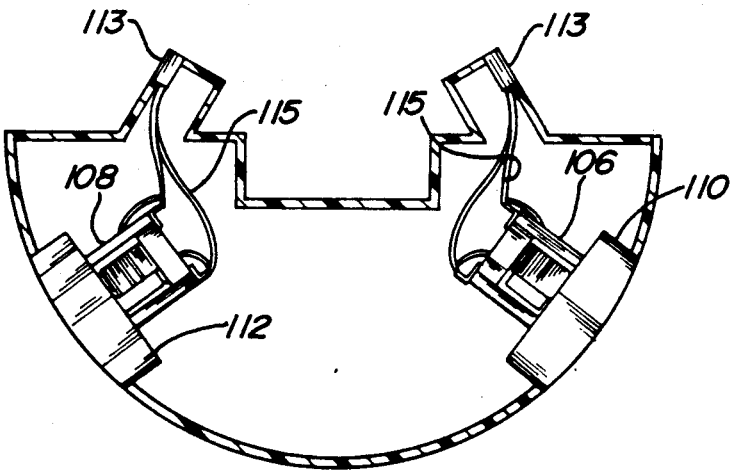
FIG. 6 is a vertical section of the lower portion of the space capsule taken along line 6—6 in FIG. 3.
Figure 7:
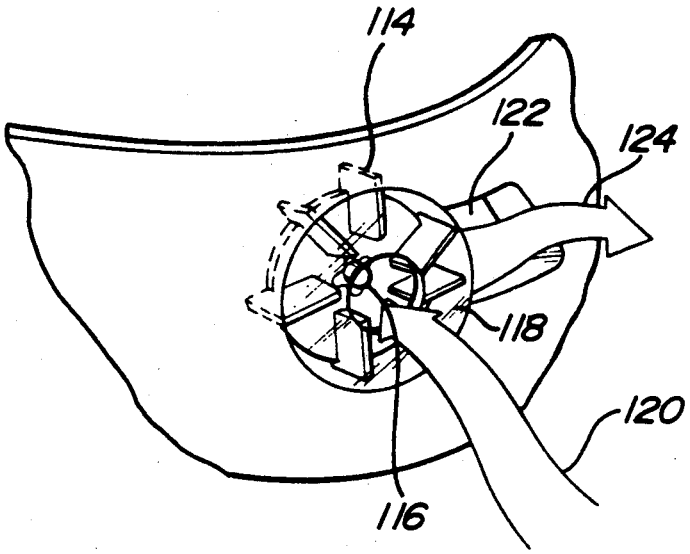
FIG. 7 is a section of the lower portion of the space capsule showing one of the side thrust fan assemblies and indicating the direction of air flow.

FIG. 6 illustrates a side view of the capsule lower portion 76 in cross section taken along line 6—6 in FIG. 3. A pair of fan motors including left thrust motor 106 and right thrust motor 108 are mounted within the lower capsule of portion 76. The left and right side thrust motors 106 and 108 may be similar to the fan motor 54 shown in FIG. 2 except they may be of a lower power capacity. Right and left side thrust motors 106 and 108 are mounted to duct portions 110 and 112 respectively, which are molded into the capsule lower portion 76. Also shown in FIG. 6 are indicator lights 113, which are connected to right and left thrust motors 106 and 108 by means of conductors 115. Consequently, when the side thrust motors 106 and 108 are energized, the corresponding indicator light is turned on. FIG. 7 illustrates side thrust fan 114 which is attached to right side thrust motor 106 by means of shaft 116. Attached to the capsule lower portion 76 is an annular shroud 118. As indicated by arrow 120, when fan 106 is energized, fan 114 will turn causing air to flow into the central opening in annular shroud 118. Duct portion 110 restricts air flow around fan 114 and directs air out of duct 110 through extended and tapered portion 122 as indicated by arrow 124. Associated with left thrust fan motor 108 and duct 112 is a second fan 114, annular shroud 118, shaft 116 and duct extended and tapered portion 122 similar to that shown in FIG. 7.

Referring now to FIG. 8, a top view of the capsule lower portion 76 with the bulk head panel 78 removed is shown. When right side thrust motor 106 is energized, air will flow past extended and tapered portion 122. When the capsule 34 is suspended within tube 30 this air flow will cause side thrust upon capsule 34 in an opposite direction to the air flow, thus causing the capsule 34 to turn about its central vertical axis in a clockwise direction according to the view of FIG. 8. Likewise, when left side thrust motor 108 is energized, air will flow out of duct tapered portion 122 thereby causing the capsule 34 to turn counterclockwise about its central axis with respect to the view shown in FIG. 8.

In accordance with the preferred embodiment of this invention, the right side thrust motor 106, left side thrust motor 108 and infrared emitting diode 94 are under the control of the user by means of radio frequency transmission. It will be appreciated that other wireless means of control, such as infrared, may also be employed. In addition, wired connections could also be used, however, it is preferred that wireless transmission be used so that the motion of the space capsule 34 is not restricted. The radio frequency controls are actuated by the user by means of a joy stick 126 shown in FIG. 1. Joy stick 126 is movable on a rotating base 128 to either the left or the right. Also trigger button 104 is contained on joy stick 126. Joy stick 126 is attached to control box 70 which is attached to transmitter controller 74 by means of conductor 72. Transmitter controller 74 is a conventional radio control transmitter which is capable of generating radio frequency signals along at least three distinct radio frequency channels. The first channel is activated by trigger button 104, the second channel is activated by movement of joy stick 126 to the right, and the third radio frequency channel is activated by movement of joy stick 126 to the left.

The receiver circuitry is contained in the capsule 34 lower portion 76. In particular, FIG. 8 illustrates a receiver circuit 130 which contains the necessary components to process the RF information transmitted by RF transmitter 74. Power to the receiver circuit board 130 is provided by battery 132. An antenna 134 is connected by means of conductor 135 to the circuit components on receiver circuit 130. It will be appreciated to those skilled in the art that the components necessary for reception of the three RF channels transmitted by transmitter control box 74 may be contained on the receiver circuit 130 using a number of conventional receiver circuit designs.

In operation, when trigger 104 is pressed by the user, transmitter control box 74 will transmit an RF signal along a first channel which will be received by antenna 134. Receiver circuit 130 will then cause infrared emitting diode 94 to be energized by battery 102. When joy stick 106 is turned to the right, RF transmitter 74 will transmit a signal along the second RF channel which will be received by antenna 134 and receiver circuit 130 will cause right side thrust motor 106 to be energized by battery 132. This will cause the capsule 34 to turn to the right, if it is in a raised position due to the air pressure from fan 54. Likewise, when joy stick 126 is moved to the left by the user, RF transmitter 74 will transmit a signal along the third RF channel which will be received by the antenna 134 and receiver circuit 130 will energize left side thrust motor 108, thereby causing the capsule 34 to turn in a counterclockwise direction. When joy stick 126 is at a vertical position, neither right or left side thrust motors 106 and 108 are energized, because RF transmitter 76 will not be transmitting an RF signal along the second and third channels.

Figure 9:
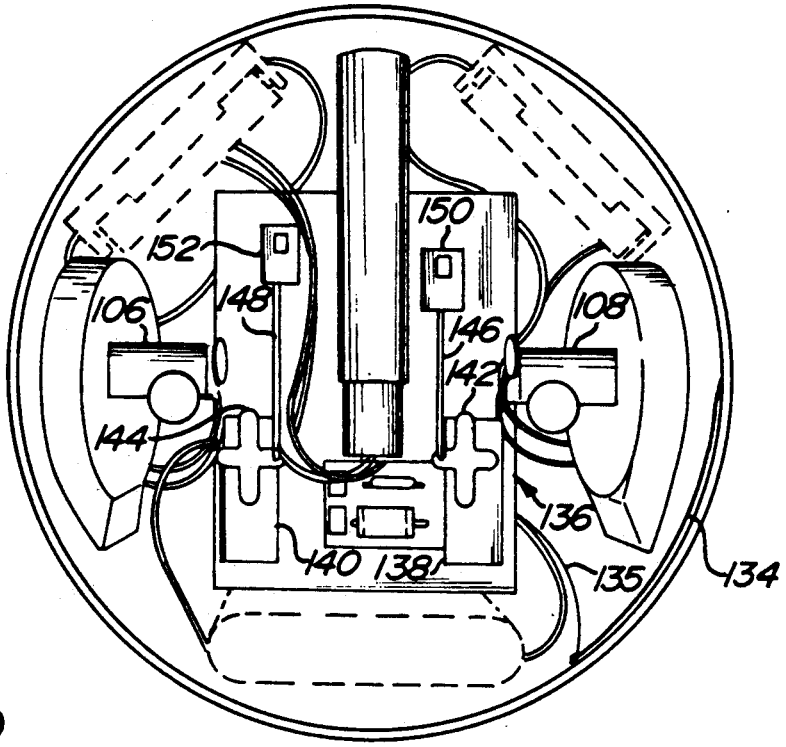
FIG. 9 is a alternative embodiment of this invention showing a top view of the lower portion of the space capsule with the cockpit removed.

FIG. 9 illustrates an alternative embodiment of the present invention. This embodiment has the advantage of using standard off the shelf receiver circuits. Receiver circuit 136 contains a standard receiver circuit such as used with remote control cars. This receiver circuit 136 may be, for example, one manufactured by Futaba Corporation, such as the "FCC data receiver: Model FP-R2GS". This Futaba receiver includes a receiver unit (not shown) attached to the underside of the circuit 136. The Futaba receiver unit is coupled to a pair of servos motor units 138 and 140. Servo motor 138 is attached to actuator 142 and servo motor 140 is attached to an actuator 144. The actuator 142 and 144 are attached to connector arms 146 and 148, which in turn are attached to switch units 150 and 152. In the embodiment shown in FIG. 9 the joy stick unit 70 and radio transmitter module 74 may be substituted by a standard Futaba transmitter system such as the model "Attack FP-T2NL digital proportional radio control system".

In operation, when the user desires to turn the space capsule 34 to the right, the joy stick 126 is moved to the right and the RF control unit 74 will transmit a radio signal along the second channel. This signal will be received by antenna 134 which is connected along conductor 135 to the receiver circuit 136 in FIG. 9. This will cause the receiver circuit 136 to cause servo motor 140 to turn, causing actuator 144 to move arm 148, thereby switching switch 152 to the on position. This will cause right thrust motor 106 to be energized. Likewise, when the user desires to turn the spacecraft 104 to the left, the joy stick 126 is moved to the left which causes RF transmitter 74 to transmit a signal along the third channel. This signal is received by antenna 134 which transmits the signal along conductor 135 to the receiver circuit 136. Receiver 136 will then, in response to the signal along the third RF channel, cause servo motor 138 to turn, thereby turning actuator 142 and moving rod 146 causing switch 150 to turn on. This will cause the left thrust motor 108 to be energized.

Figure 13:
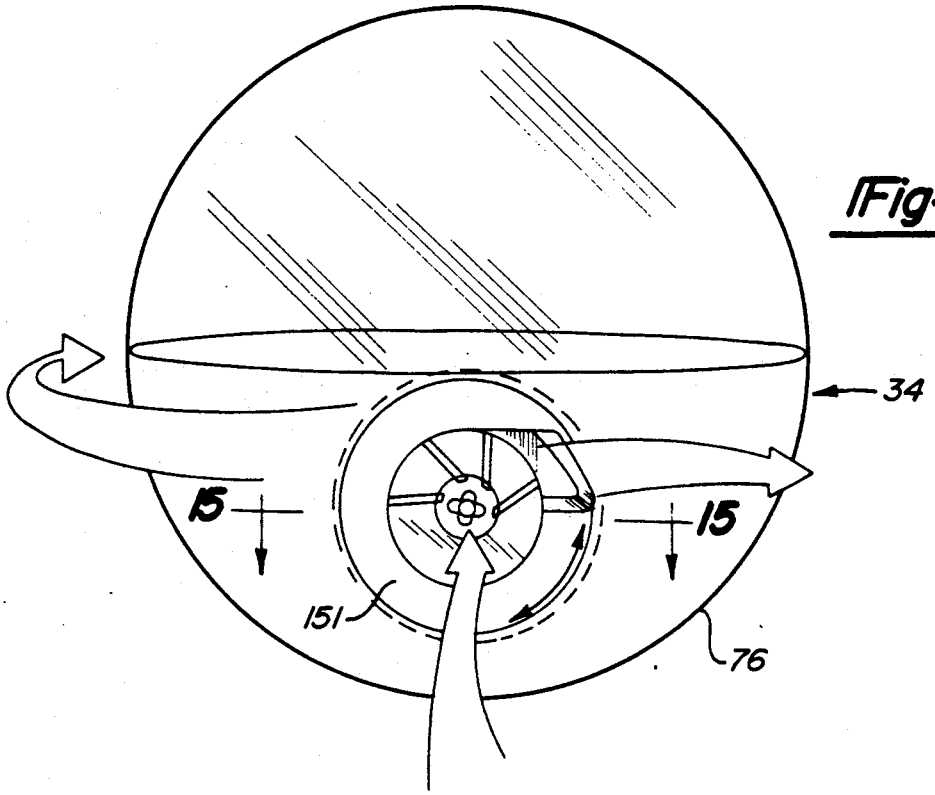
FIG. 13 is an illustration of an additional alternative embodiment of the space capsule having a rotatable duct.
Figure 14:
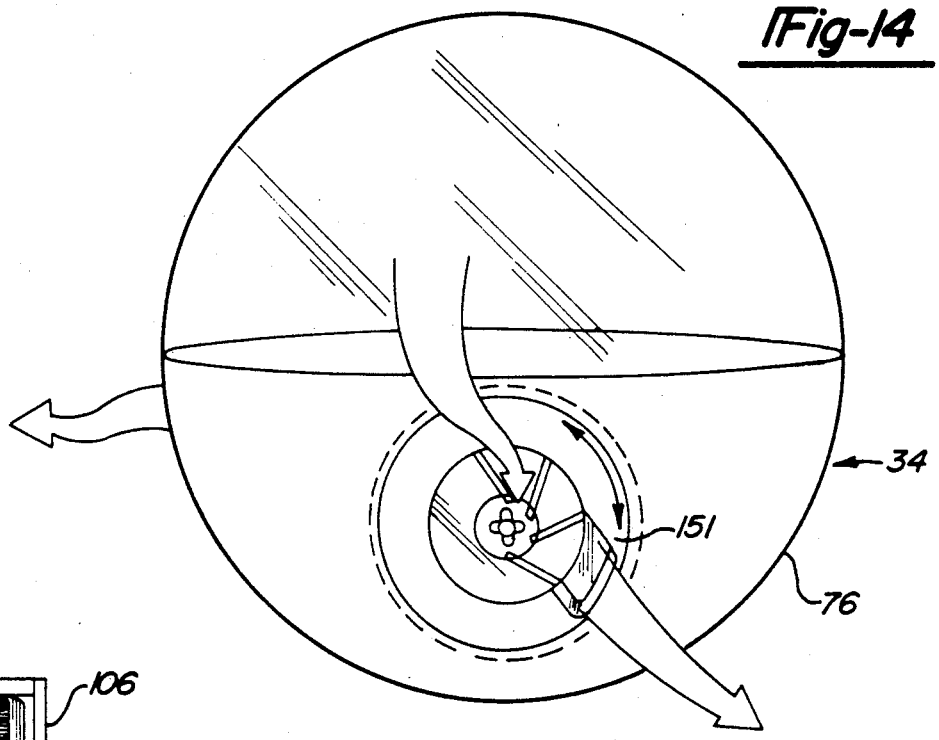
FIG. 14 is an illustration of the embodiment of FIG. 13 showing the duct rotated downward.
Figure 15:
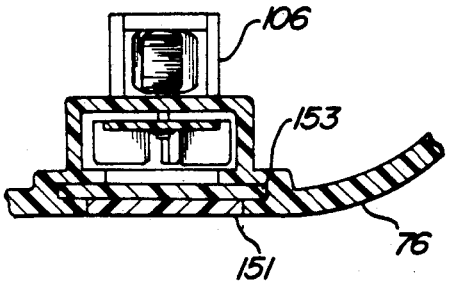
FIG. 15 is a cutaway detail of the rotatable duct taken along line 15—15 in FIG. 13.

An alternate embodiment is shown in FIGS. 13–15. This embodiment permits the angle of direction of air flow from the side thrust motors 106 and 108 to be changed. This will result in a tilting or rolling of the position of the capsule 34. In this way, the capsule 34 could even be made to do a 360° rollover. Changing the direction of side thrust is accomplished by means of a rotatable air duct 151, mounted into the body of the lower capsule portion 76. FIG. 15 shows the rotatable air duct 151 which slidably mounts into a recess portion 153 of the capsule lower portion 76. As shown in FIG. 14, the rotatable air duct 151 may thereby be rotated within the capsule lower portion 76 to cause airflow to be directed downward which will result in an upward force on one side of the capsule 34. It will be appreciated that the capsule 34 may be caused to roll in either direction by actuating either motor 106 or 108.

Figure 10:
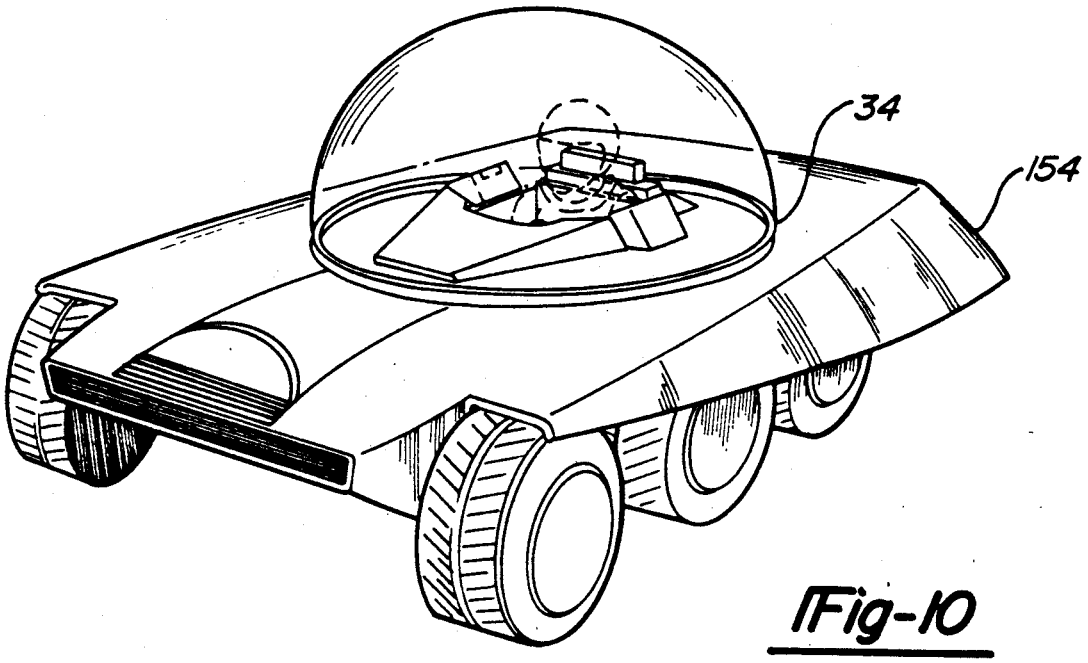
FIG. 10 is a second alternative embodiment showing the space capsule used on a vehicle.

Another form of this invention is shown by FIG. 9. Since the space capsule 34 is removable from the tube 30, it may be placed in other toys such as the vehicle 154 shown in FIG. 10. In this embodiment additional fans may be used to cause the vehicle 154 to move. Or, the side thrust motors 106 and 108 may be utilized in unison to cause forward motion of the vehicle. Alternatively, motion of the vehicle 154 may be through conventional motors attached to the wheels.

Figure 11:
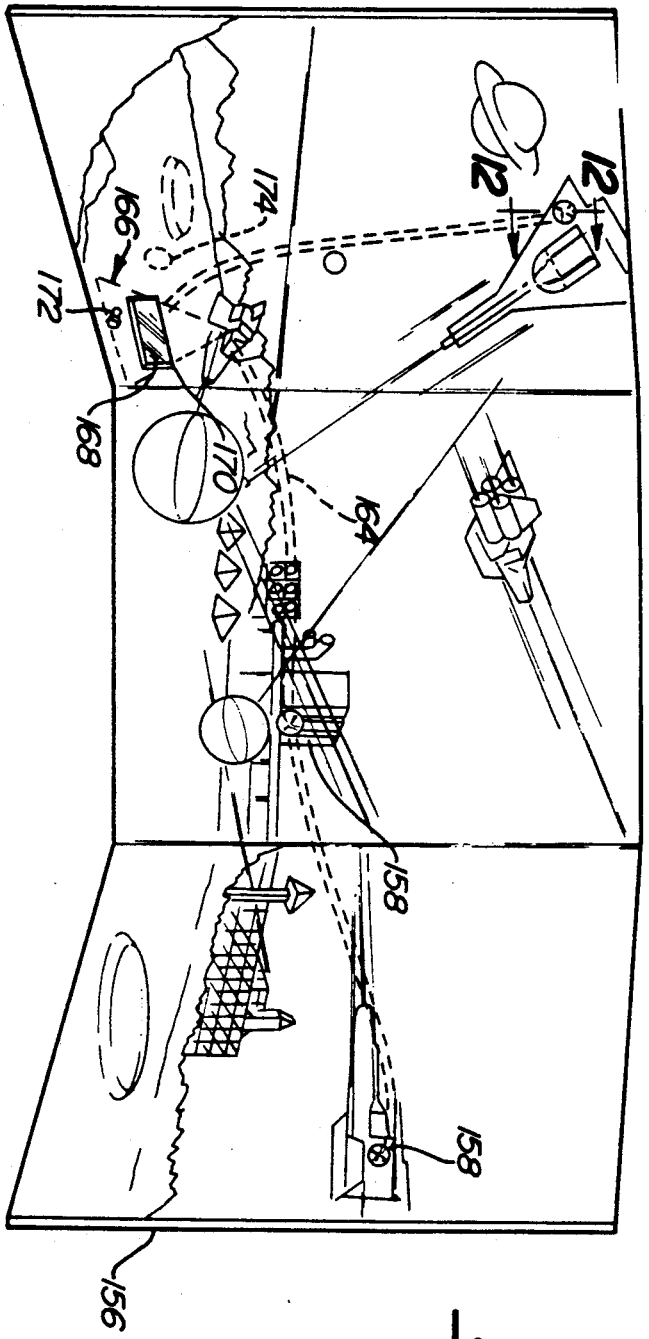
FIG. 11 is an illustration of the target space screen with sensor targets.
Figure 12:
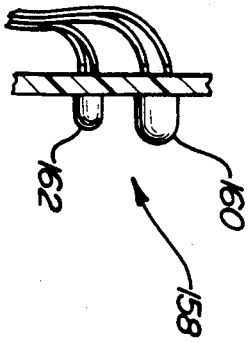
FIG. 12 is a detail of the target sensor and emitter taken along line 12—12 in FIG. 11.

While the spaceship capsule 34 and associated components, as discussed above, may be used simply as a toy, these components may be incorporated into a game to provide greater interest and challenge for the user. Referring to FIG. 1, the spaceship toy and game 10 is shown including a space city screen 156. The space city screen 156 provides a background setting depicting a space city, planets and other aircraft, which enhance the realism of the spaceship toy and game 10. In addition, the space city screen incorporates a number of sensor targets 158 which permit the spacecraft 34 to be used in a game. In particular, each sensor target 158 contains a sensor 160 and an emitter 162 as shown in FIG. 12, which is a cross-section of FIG. 11 taken along lines 12—12. The sensor targets 158 are connected by means of conductors 164 which are attached to the rear of the space city screen 156 to a game control board 166. A liquid crystal display 168 is also mounted on game control board 166 which is visible through an opening 170 in the space city screen 156. A game start button 172 is also mounted to the game control board 166 and protrudes through space city screen 156 to permit actuation of the button by the user from the front of the screen 156. In addition, a speaker 174 may be mounted to the back of the space city screen 156.

When playing the spaceship toy and game 10 of the present invention, the user will first switch a main power switch 174 on the radio frequency transmitter box to the on position. This will connect the transmitter circuit 174 to a source of external power (not shown). The user may then turn the rotatable knob 168, to energize the first fan 54 thereby causing the space capsule 34 to raise within the tube 30. The game start button 172 may then be pressed. The user may then turn the capsule 34 to the left or to the right by means of pushing the joy stick 126 to the left or right as desired and as described in detail above. In this way the user may aim the laser cannon 84 until it is pointing at one of the targets 158 on the space city screen 156. Aiming will require turning the knob 68 to adjust the height of the laser cannon as well as moving joy stick 126 to the left or to the right to turn the capsule 34 in the correct direction.

Once the laser cannon is aimed at one of the targets 158, the user may pull the trigger button 104 on the joy stick 126 to energize the infrared diode 94 within the laser cannon 84. This will cause an infrared beam to be directed at the target 156. If the laser cannon 84 is aimed correctly, the beam will be detected by the photo detector 160 and a current will flow in detector 160 which will be transmitted along conductor 164 to the game control board 166. When the game control board 166 receives a current from one of the photo detectors 160, it will respond in some fashion. For example, this response may be to produce an audible sound in the speaker 174 or to indicate a score on the liquid crystal display 168. In a preferred embodiment, to increase the challenge of playing with the present invention, light emitting diodes 162 located at each target 158 may be lit in a random sequence for a period of time under the control of game control board 166. For example, once the game start button 172 is pressed by the user, the game control board 166 will begin a timing sequence which will energize the light emitting diodes 166 in a random pattern for a predetermined period of time. The object for the user will be to manipulate the space capsule 34 and to fire the laser cannon 84 to hit the target 158 which has its LED 162 lit. Only if a lit target 158 is struck with the infrared beam from the laser cannon 84, will the control board 166 respond by adding a score on the liquid crystal display 168 or by generating a sound. Increasingly difficult levels of play may be produced by having the interval during which the LEDs 166 are lit become progressively smaller. For example there may be ten different levels of play. The easiest level would give the user 35 seconds in which to hit the target 158, while the most difficult, or tenth level, would give the user only 1/10th of a second to hit each target.

It will be appreciated by those skilled in the art that the control board 166 may be constructed of conventional integrated circuits to perform the functions of controlling and timing the light emitting diodes 166, the liquid crystal displays 168, etc. Additional functions which could be easily implemented by the game controller 166 include additional sounds. For example, special sounds may be generated when the wrong target is hit, when a target is hit when the LED is not lit, when the game begins or ends, or random background sounds may be employed such as those of the other spacecraft, music, etc. In addition, control board 166 could perform the function of scorekeeping for one or for more than one user. An additional embodiment incorporates a plurality of spaceship toy and games 10 in which photo detectors such as those 160 on the target 158 may be incorporated into the space capsule 34. This would permit two space capsules 34 to fire their laser cannons 84 at each other. For example, a hit by another laser cannon 84 may cause the space capsule 34 to drop by cutting power to the first fan 54.

While the above description constitutes the preferred embodiments of the present invention, it will be appreciated that the invention is susceptible to modification, variation and change without departing from the proper scope and fair meaning of the accompanying claims.

What is claimed is:

1. A spaceship toy comprising:

a space capsule;

an elongated tube having a central axis, said tube closely receiving said capsule;

first fan means supplying air pressure at one end of said tube, said air pressure acting upon said capsule wherein said capsule is translatable within said tube; and second fan means disposed on said space capsule, said second fan means supplying an air stream directed in a direction generally transverse to said central axis, wherein said space capsule is rotated about said central axis of said elongated tube.

2. The spaceship toy according to claim 1 further comprising a third fan means disposed on said space capsule, said third fan means supplying an airstream directed in a direction generally opposite to the direction of that of the second fan means, whereby said space capsule will be rotated in a direction opposite to that caused by said second fan means.

3. The spaceship toy according to claim 2 wherein said space capsule further includes a pair of ducts each disposed adjacent to one of said second and third fan means for carrying an airstream from the adjacent fan means, said ducts being partially formed by a recessed portion in the outer surface of said space capsule, said recessed portion including a circular shaped portion surrounding said fan means and a narrowing portion extending away from said circular portion.

4. The spaceship toy according to claim 3 further comprising:

annular shroud member having a central opening permitting air to be drawn into said fan means, said annular shroud member also serving to direct air from said fan means to said duct means.

5. The spaceship toy according to claim 2 further comprising means for selectively energizing each of said second and third fan means, whereby said space capsule may be selectively rotated in a desired direction about said axis of said elongated tube.

6. The spaceship toy according to claim 1 wherein said space capsule further comprises a substantially transparent upper spherical portion and a lower spherical portion.

7. The spaceship toy according to claim 1 further comprising means for energizing and controlling said first fan means, whereby said space capsule may be raised and lowered in said tube.

8. The spaceship toy according to claim 1 wherein said central axis is oriented generally vertically and said one end of said tube is the lower end.

9. The toy according to claim 8 wherein said means for energizing said first fan means comprises a wireless transmitter unit.

10. The toy according to claim 1 wherein said means for energizing said second and third fan means comprises a wireless transmitter and receiver unit.

11. A spaceship game comprising:

a space capsule including a lower spherical portion;

an elongated tube having a central axis said tube closely receiving said capsule;

first fan means supplying air pressure at one end of said tube, said air pressure acting upon said capsule wherein said capsule is translatable within said tube;

second fan means disposed on said space capsule, said second fan means supplying an air stream directed in a direction generally transverse to said central axis wherein said space capsule is rotated about said central axis of said elongated tube;

third fan means disposed on said space capsule, said third fan means supplying an air stream directed in a direction generally opposite to the direction of that of the second fan means, whereby said space capsule is rotated in a direction opposite to that caused by said second fan means;

means for selectively energizing one of said second and third fan means, whereby said space capsule may be selectively rotated in a desired direction about said axis of said elongated tube;

means for energizing and controlling said first fan means, whereby said space capsule may be raised or lowered in said tube;

gun means disposed on said space capsule for directing a beam of energy;

means for energizing said gun means;

at least one target means having a detector responsive to said beam of energy; and means for notifying persons playing said spaceship game when said beam of energy is detected by said detector.

12. The spaceship game of claim 11 wherein said target means further comprises means for activating selected ones of said targets, and a light means for notifying the user which of said targets is active, wherein said means for notifying will only respond if said target is activated when a beam of energy is detected.

13. The game according to claim 11 wherein said means for energizing said first fan means comprises a wireless transmitter unit.

14. The game according to claim 11 wherein said means for energizing said second and third fan means comprises a wireless transmitter and receiver unit.

15. A spaceship toy and game comprising:

a spherical space capsule having a substantially transparent upper portion and a lower portion;

an elongated tube oriented with its central axis substantially vertical said tube closely receiving said capsule;

first fan means supplying air pressure at one end of said tube, said air pressure acting upon said capsule wherein said capsule is translatable within said tube;

second fan means disposed on said space capsule, said second fan means supplying an air stream directed in a direction generally transverse to said central axis, wherein said space capsule is rotated about said central axis of said elongated tube;

third fan means disposed on said space capsule, said third fan means supplying an air stream directed in a direction generally opposite to the direction of that of the second fan means;

a pair of ducts each disposed adjacent to one of said second and third fan means for carrying an airstream from the adjacent fan means, said ducts being partially formed by a recessed portion in the outer surface of said space capsule, said recessed portion including a circular shaped portion surrounding said fan means and a narrowing portion extending away from said circular portion;

means for selectively energizing one of said second and third fan means, whereby said space capsule may be selectively rotated in a direction about said central axis in said elongated tube;

means for energizing and controlling said first fan means, whereby said space capsule may be raised or lowered in said tube;

gun means disposed on said space capsule for directing a beam of energy;

means for energizing said gun means;

at least one target means having a detector responsive to said beam of energy; and means for notifying persons playing said spaceship game when said beam of energy is detected by said detector.

* * * * *